US010433060B2

(12) United States Patent
Feld et al.

(10) Patent No.: US 10,433,060 B2
(45) Date of Patent: Oct. 1, 2019

(54) AUDIO HUB AND A SYSTEM HAVING ONE OR MORE AUDIO HUBS

(71) Applicant: DSP GROUP LTD., Herzeliya (IL)

(72) Inventors: Eran Feld, Tel Aviv (IL); Fredy Rabin, Tel Aviv (IL); Gad Molkho, Zikhron-Ya'akov (IL)

(73) Assignee: DSP Group Ltd, Herzliya (IL)

( * ) Notice: Subject to any disclaimer, the term of this patent is extended or adjusted under 35 U.S.C. 154(b) by 0 days.

(21) Appl. No.: 15/965,933

(22) Filed: Apr. 29, 2018

(65) Prior Publication Data

US 2018/0317009 A1 Nov. 1, 2018

Related U.S. Application Data

(60) Provisional application No. 62/492,211, filed on Apr. 30, 2017.

(51) Int. Cl.

| | |
|---|---|
| ***H04R 3/14*** | (2006.01) |
| ***H04R 25/00*** | (2006.01) |
| ***H04R 5/04*** | (2006.01) |
| ***H04R 27/00*** | (2006.01) |

(52) U.S. Cl.

CPC ..... *H04R 3/14* (2013.01); *H04R 5/04* (2013.01); *H04R 25/43* (2013.01); *H04R 27/00* (2013.01); *H04R 2201/405* (2013.01); *H04R 2227/003* (2013.01)

(58) Field of Classification Search

None

See application file for complete search history.

(56) References Cited

U.S. PATENT DOCUMENTS

| | | | | |
|---|---|---|---|---|
| 2012/0237053 | A1* | 9/2012 | Alam | H04L 12/00 381/80 |
| 2012/0300960 | A1* | 11/2012 | Mackay | H04H 60/04 381/119 |
| 2018/0279050 | A1* | 9/2018 | Ryu | G10L 19/00 |

* cited by examiner

*Primary Examiner* — Curtis A Kuntz
*Assistant Examiner* — Kenny H Truong
(74) *Attorney, Agent, or Firm* — Reches Patents

(57) ABSTRACT

There may be provided a system that may include a processor and an audio hub; wherein the audio hub may include first communication interfaces, a second communication interface, a processor, and a memory; wherein the first communication interfaces may be configured to exchange audio signals with a group of audio components of different types; wherein an aggregate number of first communication interface bits exceeds a number of second communication interface bits; wherein the audio signals may include input audio signals received from the group and output audio signals transmitted to the group; wherein the processor may be configured to generate an input multiplex of input audio signals; and wherein the second communication interface may be configured to transmit the input multiplex to the processor and to receive an output multiplex from the processor.

24 Claims, 10 Drawing Sheets

AUDIO HUB AND A SYSTEM HAVING ONE OR MORE AUDIO HUBS

CROSS REFERENCE

This application claims priority of provisional patent Ser. No. 62/492,211, filing date Apr. 30, 2017.

BACKGROUND

Various products are required to support many audio/speech interfaces in order to allow its user variety of connectivity options. Together with large amount of different audio/speech protocols, the outcome is the need to integrate, into the product, extensive number of components. In addition, the need to support legacy interfaces (e.g. analog) together with modern ones (e.g. digital), each with different characteristics (e.g. bandwidth), imposes the products' design to be flexible and scalable.

Therefore, there is growing need to provide a single point (chip) which will handle and route the audio subsystem.

SUMMARY

There may be provided a system that may include a processor and an audio hub; wherein the audio hub may include first communication interfaces, a second communication interface, a processor, and a memory; wherein the first communication interfaces may be configured to exchange audio signals with a group of audio components of different types; wherein an aggregate number of first communication interface bits exceeds a number of second communication interface bits; wherein the audio signals may include input audio signals received from the group and output audio signals transmitted to the group; wherein the processor may be configured to generate an input multiplex of input audio signals; and wherein the second communication interface may be configured to transmit the input multiplex to the processor and to receive an output multiplex from the processor.

The audio hub may be configured to generate the input multiplex based on a mapping stored in the audio hub.

The audio hub may be configured to generate the input multiplex based on types of audio signals requested by the processor and based on a usage of the first communication interfaces.

The audio hub may be configured to generate the input multiplex to include audio signals of different rate.

The audio hub may be configured to generate the input multiplex by truncating audio signal chunks.

The audio hub may be configured to generate the input multiplex from audio signals received from one or more wireless modems, from one or more CODEC and from one or more digital microphones.

The audio hub may be configured to generate the input multiplex from audio signals received from wireless antennas, from wired cables, and from digital microphones.

The system wherein first communication interfaces may include a first plurality of time division multiplex buses.

The system may include an additional audio hub; wherein the processor may be configured to control the additional audio hub.

The additional audio hub may include additional first communication interfaces, an additional second communication interface, an additional processor, and an additional memory; wherein the additional first communication interfaces may be configured to exchange audio signals with an additional group of audio components of different types; wherein an aggregate number of additional first communication interface bits exceeds a number of additional second communication interface bits; wherein the additional audio signals may include additional input audio signals received from the additional group and additional output audio signals transmitted to the additional group; wherein the additional processor may be configured to generate an additional input multiplex of additional input audio signals; and wherein the additional second communication interface may be configured to transmit the additional input multiplex to the processor and to receive an additional output multiplex from the processor.

The processor may be configured to control the first and second audio hubs using a shared control bus.

The additional second communication interface and the second communication interface may be coupled to the processor over a shared bus.

There may be provided a method for operating the audio hub.

There may be provided a method that may include exchanging, by first communication interfaces of an audio hub, audio signals with a group of audio components of different types; wherein an aggregate number of first communication interface bits exceeds a number of second communication interface bits; wherein the audio hub also may include a second communication interface, a processor, and a memory; wherein the audio signals may include input audio signals received from the group and output audio signals transmitted to the group; generating, by the processor, an input multiplex of input audio signals; transmitting, by the second communication interface, the input multiplex to the processor; and receiving, by the second communication interface, an output multiplex from the processor.

The method may include generating, by the audio hub, the input multiplex based on a mapping stored in the audio hub.

The method may include generating, by the audio hub, the input multiplex based on types of audio signals requested by the processor and based on a usage of the first communication interfaces.

The method may include generating, by the audio hub, the input multiplex to include audio signals of different rate.

The method may include generating, by the audio hub, the input multiplex by truncating audio signal chunks.

The method may include generating, by the audio hub, the input multiplex from audio signals received from one or more wireless modems, from one or more CODEC and from one or more digital microphones.

The method may include generating, by the audio hub, the input multiplex from audio signals received from wireless antennas, from wired cables, and from digital microphones.

The first communication interfaces may include a first plurality of time division multiplex buses.

The audio hub may include an additional audio hub; wherein the method may include controlling, by the processor, the additional audio hub.

The additional audio hub may include additional first communication interfaces, an additional second communication interface, an additional processor, and an additional memory; wherein the method may include: exchanging, by the additional first communication interfaces, audio signals with an additional group of audio components of different types; wherein an aggregate number of additional first communication interface bits exceeds a number of additional second communication interface bits; wherein the additional audio signals may include additional input audio signals received from the additional group and additional output audio signals transmitted to the additional group; generating, by the additional processor, an additional input multiplex of additional input audio signals; transmitting, by the additional second communication interface, the additional input multiplex to the processor; and receiving, by the additional second communication interface, an additional output multiplex from the processor.

The method may include controlling, by the processor, the first and second audio hubs using a shared control bus.

The additional second communication interface and the second communication interface may be coupled to the processor over a shared bus.

BRIEF DESCRIPTION OF THE DRAWINGS

In order to understand the invention and to see how it may be carried out in practice, a preferred embodiment will now be described, by way of non-limiting example only, with reference to the accompanying drawings.

DETAILED DESCRIPTION OF THE DRAWINGS

Figure 1:
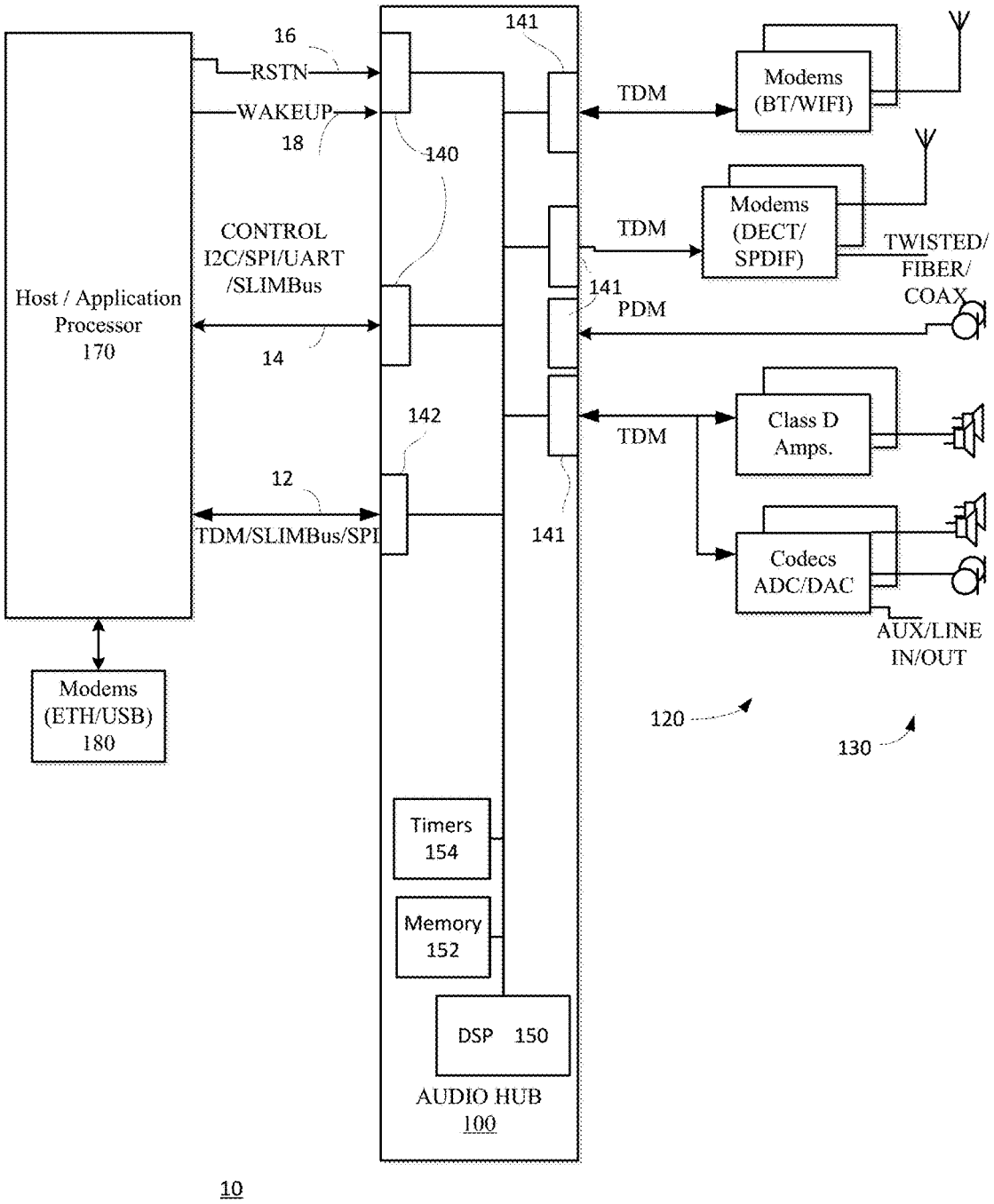
FIG. 1 illustrates an audio hub and multiple devices according to an embodiment of the invention.

There is provided a system that may accommodate the following functionalities and interfaces:

- Supporting recording, automatic speech recognition and various voice calls methods that require either analog or digital microphones to capture the users' voice.
- Supporting playback and voice calls that require different types of speakers such as earpiece, headsets, headphones, loudspeakers etc.
- Provide wire connectivity between audio/speech devices that includes analog auxiliary and/or line input and output. Supports other wire interfaces such as analog or digital SPDIF (Sony/Philips Digital Interface Format) over fiber optic, coaxial or twisted pair cables.
- Supports wireless connectivity between audio/speech devices includes BT (Bluetooth), WiFi, DECT (Digital Enhanced Cordless Telecommunications), etc.
- Supports other communication protocols that support audio/speech transfer, such as Cellular 2/3/4 G, ETH (Ethernet), USB (Universal Serial Bus), etc.
- Supports other family products which needs to interface with each other.

To support the various audio/speech inputs and outputs above, different components/elements are integrated in the system, such as:

- Codecs which include number of analog to digital converters A/Ds & digital to analog converters D/A, mainly for analog audio/speech.
- Amplifiers such as Class D amplifier connected to loudspeakers.
- Wire modems to support the various wire interfaces mentioned above such as SPDIF.
- Wireless Modems such as Cellular 2/3/4G, WiFi, Bluetooth, DECT, etc, which streams in and out voice and audio data from and to local and remote sources.
- Host processor which interfaces other communication chips (e.g. Ethernet, USB, etc.) together with aggregating the entire audio channels.

These elements transfers (transmits & receives) the audio samples through various interfaces, such as:

- Time Division Multiplexing (TDM) in general of PCM (Pulse-code modulation, mono)/I2S (Inter-IC Sound, stereo) as a subset. The most commonly used interface for audio and speech.
- Serial Low-power Inter-chip Media Bus (SLIMBus)
- Serial Peripheral Interface (SPI).
- Pulse Density Modulation (PDM) for Digital Microphones.

The system has an audio hub in addition to a single host processor—so that the host processor is not required to solely handle many of the products features. Such as: User Interface, LCD, Video, Ethernet communication, USB communication, SD Card, Flash, Etc.

The system overcomes the limitations of the host processor in terms of audio: (a) the host processor does not have all required audio interfaces (b) the host processor does not have the required amount of audio interfaces in order to support the entire audio sub-system requirements. (c) when the host processor is also required to manage audio routing—host processor is not able to dedicate its processing power for control entire system, algorithms & operating system.

The audio hub includes (a) first communication interfaces for exchanging audio and control signals with multiple audio devices and (b) one or more second communication interfaces for exchanging audio and control information with a processor or with a device that includes a processor.

The term audio includes speech and non-speech audio signals.

The processor has less communication interfaces than the number of first communication interfaces of the audio hub.

The processor may not have dedicated communication interfaces that are tailored to directly support all the type of the communications supported by the first communication interfaces of the audio hub.

For example—the processor may include a single communication interface while the audio hub may include first communication interfaces that are dedicated to different protocols (e.g. different sampling rate, different sample width, etc.) that support audio such as Bluetooth, DECT, and various TDM or other protocols.

The audio hub also allows a necessary feature of on the fly/seamless changes (e.g. constructing of a channel, channel dropping, changes in sampling rate, etc.) in one of the first communication interfaces (e.g. Bluetooth) while maintaining a flawless communication with the rest of the elements.

The audio hub may receive content (including audio and control signals and even other signals) that is conveyed over first communication channels and from multiple audio devices. The audio hub may multiplex the received content to provide a multiplex that is sent to the processor through the second communication interface of the audio hub. When the processor is coupled to more than a single second communication interface—the audio hub may generate more than a single multiplex.

The content of the multiplex—and especially the mapping between first communication channels and the multiplex (for example which time slots, time frames of the multiplex are allocated to each first communication channel) may be sent to the processor (for example—during a programming session).

The mapping between first communication channels and the multiplex may be determined by the audio hub. The audio hub may determine the mapping based on requests from the processor (which first communication channels should be supported), based on active or non-active first communication channels, and the like.

The audio hub may monitor the activity of the communication channels, determine when a first communication channel is inactive, may learn profiles of usage of first communication channels and predict the future usage of the first communication channels, and determine the mapping accordingly.

The audio hub may include, in addition to the first and second communication interfaces, a communication channel processor that may be configured to perform routing, multiplexing, de-multiplexing, and any other operations (including audio processing, e.g. Sample Rate Conversion (SRC)) on the content conveyed over the first communication channels.

The audio hub may transfer control signals and may allow (by transfer of the control signals from one audio device to another audio device) the audio device to control the other audio device.

Multiple audio hubs may be coupled to each other.

Figure 2:
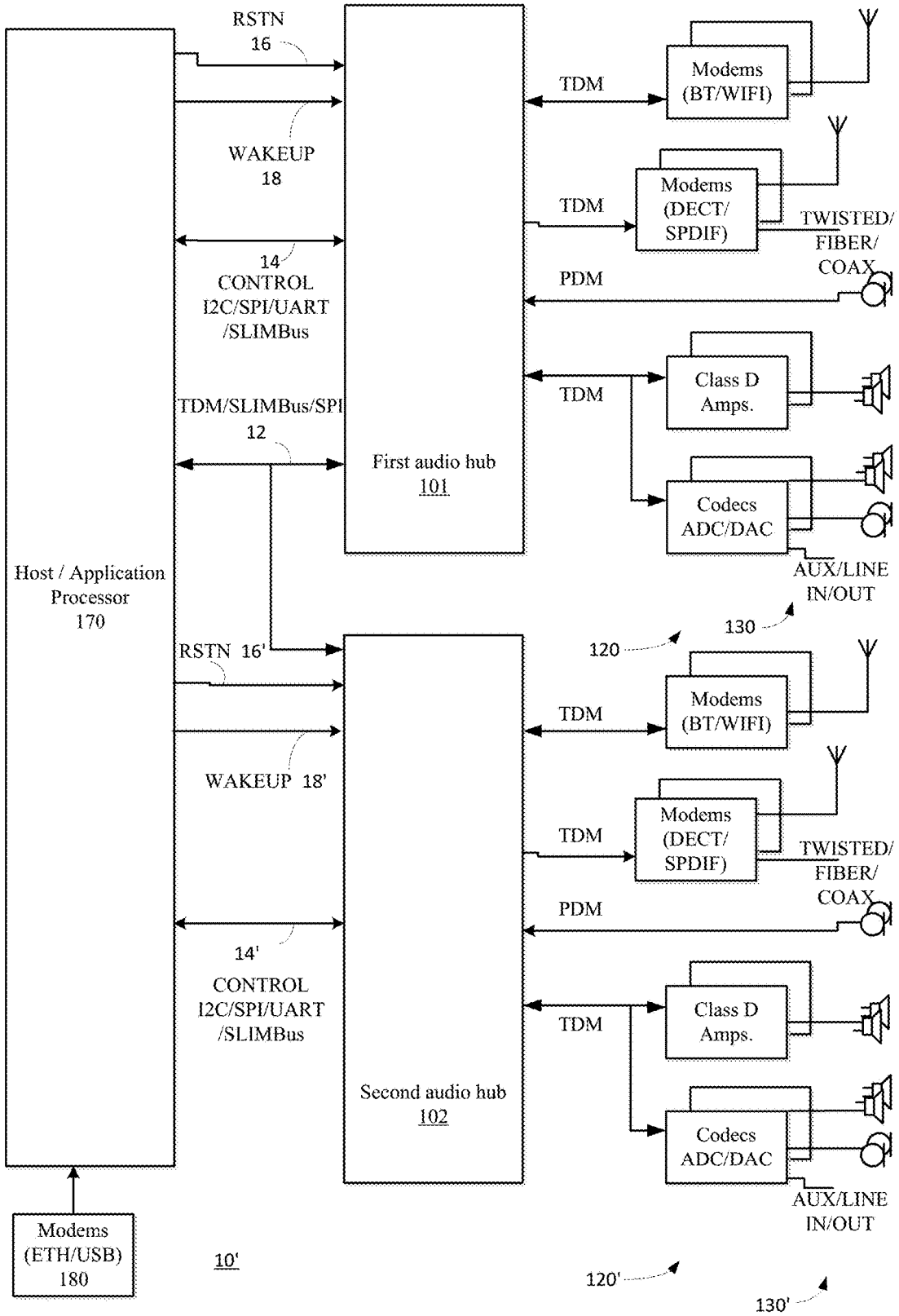
FIG. 2 illustrates two audio hubs and multiple devices according to an embodiment of the invention.

FIGS. 1-3 illustrates systems (10, 10' and 10" respectively) that include one or more audio hubs.

FIG. 1 illustrates a single audio hub 100. FIG. 2 illustrates a pair of audio hubs (first audio hub 101 and second audio hub 102). FIG. 3 illustrates a single audio hub 400.

Each one of the audio hubs may be an integrated circuit DBMDx (x stands for any IC chip which is a member of the DBM family) of DSP group of Herzliya Israel. This is merely a non-limiting example of an audio hub. Any processors may be used.

When implemented using the DBMD2—the audio hub has a powerful DSP to meet tight timing constraints & high frequency transferred audio. The DBMD2 exhibits low power consumption. The DBMD2 together with a host processor allows short in-out delay of each channel (order of a few samples=~100 uSecs).

The audio devices, interfaces and communication protocols of FIGS. 1 and 2 include:

a. SLIMBus—Serial Low-power Inter-chip Media Bus.
b. SPI—Serial peripheral interface bus.
c. I2C—Inter-Integrated Circuit.
d. TDM—time division multiplex.
e. UART—universal asynchronous receiver-transmitter.
f. PDM—Pulse-density modulation.
g. ETH—Ethernet.
h. USB—Universal Serial Bus.
i. BT—Bluetooth—a type of wireless technology.
j. WIFI—a type of a wireless networking technology.
k. DECT—Digital Enhanced Cordless Telecommunications.
l. SPDIF—Sony/Philips Digital Interface.
m. JTAG—Joint Test Action Group.
n. ADC—analog to digital converter.
o. DAC—digital to analog converter.

Audio hub 100 of FIG. 1 is coupled to components (collectively denoted 120) such as BT/WIFI modems, DECT/SPDIF modems, digital microphones, class D amplifiers and codecs that may include ADCs and/or DACs. These components may be coupled to additional components (collectively denoted 130) such as antennas, wires (twisted pairs, fibers, coaxial wires, auxiliary wires, input wire or output wire), speakers, and the like.

These audio devices, interfaces and communication protocols are merely provided as non-limiting examples.

In these figures:

a. The audio hub has multi audio interfaces: up to 4× full duplex TDMs, SPI (control bus 14), up to 4 Digital Microphones (via PDM interface), SLIMBus 12.
b. The audio hub has multi Control Interfaces such as: UART, I2C, SPI, SLIMBus.
c. Routing of each input channel to its desired output/outputs with various options to Demux & Mux each channel supporting various audio frequencies (8 Ksps, 16 Ksps, 48 Ksps etc.) and sample widths (16 b, 24 b, etc.).
d. The audio hub supports programmable/dynamic configuration through a map (referred to as RegMap) of required interface together with the routing table.
e. The audio hub has a low power consumption chip.
f. The audio hub may be coupled to other audio hubs (see, for example, FIG. 2).

In FIG. 1 the audio hub 100 is illustrated as including a bus or interconnect that is shared by DSP 150, memory 152, timers 154, and various interfaces such as first communication interfaces 141, second communication interface 142 and various other interfaces 140 for receiving control signals.

First communication interfaces 141 are coupled to:

a. First TDM bus—that is coupled to BT/WIFI modems. The BT/WIFI modems are coupled to an antenna.
b. Second TDM bus—that is coupled to DECT/SPDIF modems. One DECT/SPDIF modem is coupled to an antenna. Another DECT/SPDIF modem is coupled to a wire such as twisted pairs, fibers or coaxial wires.
c. PDM bus that is coupled to digital microphones.
d. Third TDM bus—that is coupled to class D amplifiers and to codecs. The class D amplifiers and the codecs feed speakers. The codecs may also be coupled to a wire such as an auxiliary wires, an input wire or an output wire.

Audio hub 100 is illustrates as receiving from host processor (may be an application processor) 170—a reset signal RSTN 16, a WAKEUP signal 18, and may receive and/or output control signals over control bus 14 that may be a I2C and/or SPI and/or UART bus.

Second communication interface 142 is coupled to an audio/data bus such as TDM and/or SLIMBus and/or SPI bus 12.

Host processor 170 is also coupled to ethernet/USB modems 180.

In FIG. 2 there are two audio hubs—101 and 102 that are coupled to host processor 170.

Bus 12 is shared between the first and second audio hubs and the host processor 170.

First audio hub 101 is illustrates as receiving from host processor (may be an application processor) 170—a reset signal RSTN 16, a WAKEUP signal 18, and may receive and/or output control signals over control bus 14 that may be a I2C and/or SPI and/or UART bus.

First audio hub 101 is coupled to components (collectively denoted 120) such as BT/WIFI modems, DECT/

SPDIF modems, digital microphones, class D amplifiers and codecs that may include ADCs and/or DACs. These components may be coupled to additional components (collectively denoted 130) such as antennas, wires (twisted pairs, fibers, coaxial wires, auxiliary wires, input wire or output wire), speakers, and the like.

Second audio hub 102 is illustrates as receiving from host processor (may be an application processor) 170—a reset signal RSTN 16', a WAKEUP signal 18', and may receive and/or output control signals over control bus 14' that may be a I2C and/or SPI and/or UART bus.

Second audio hub 102 is coupled to components (collectively denoted 120') such as BT/WIFI modems, DECT/SPDIF modems, digital microphones, class D amplifiers and codecs that may include ADCs and/or DACs. These components may be coupled to additional components (collectively denoted 130') such as antennas, wires (twisted pairs, fibers, coaxial wires, auxiliary wires, input wire or output wire), speakers, and the like.

First and second audio hubs may be coupled to components and other components that differ from those illustrated in FIGS. 1 and 2.

Figure 3A:
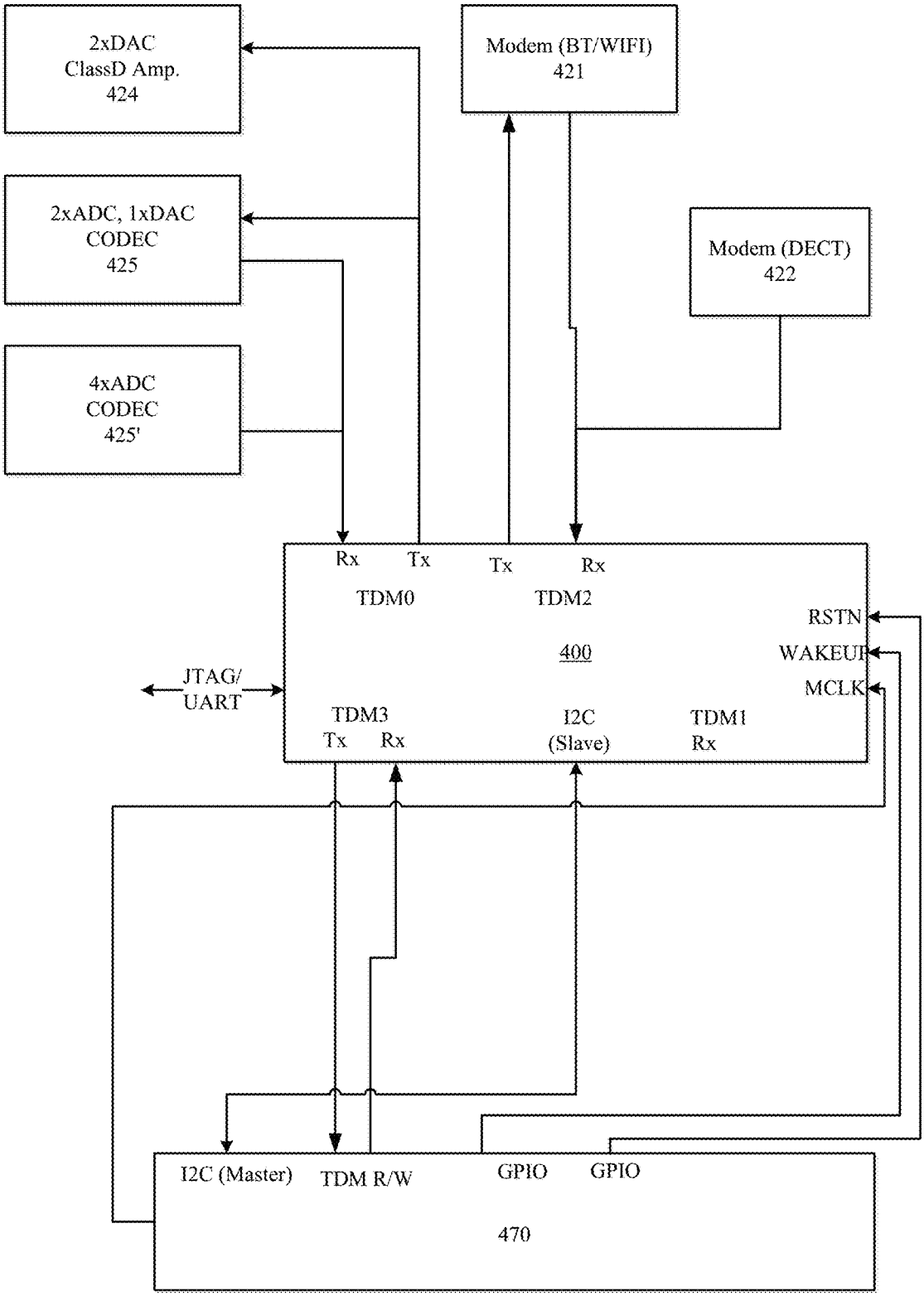
FIG. 3A illustrates an audio hub and multiple devices according to an embodiment of the invention.
Figure 3B:
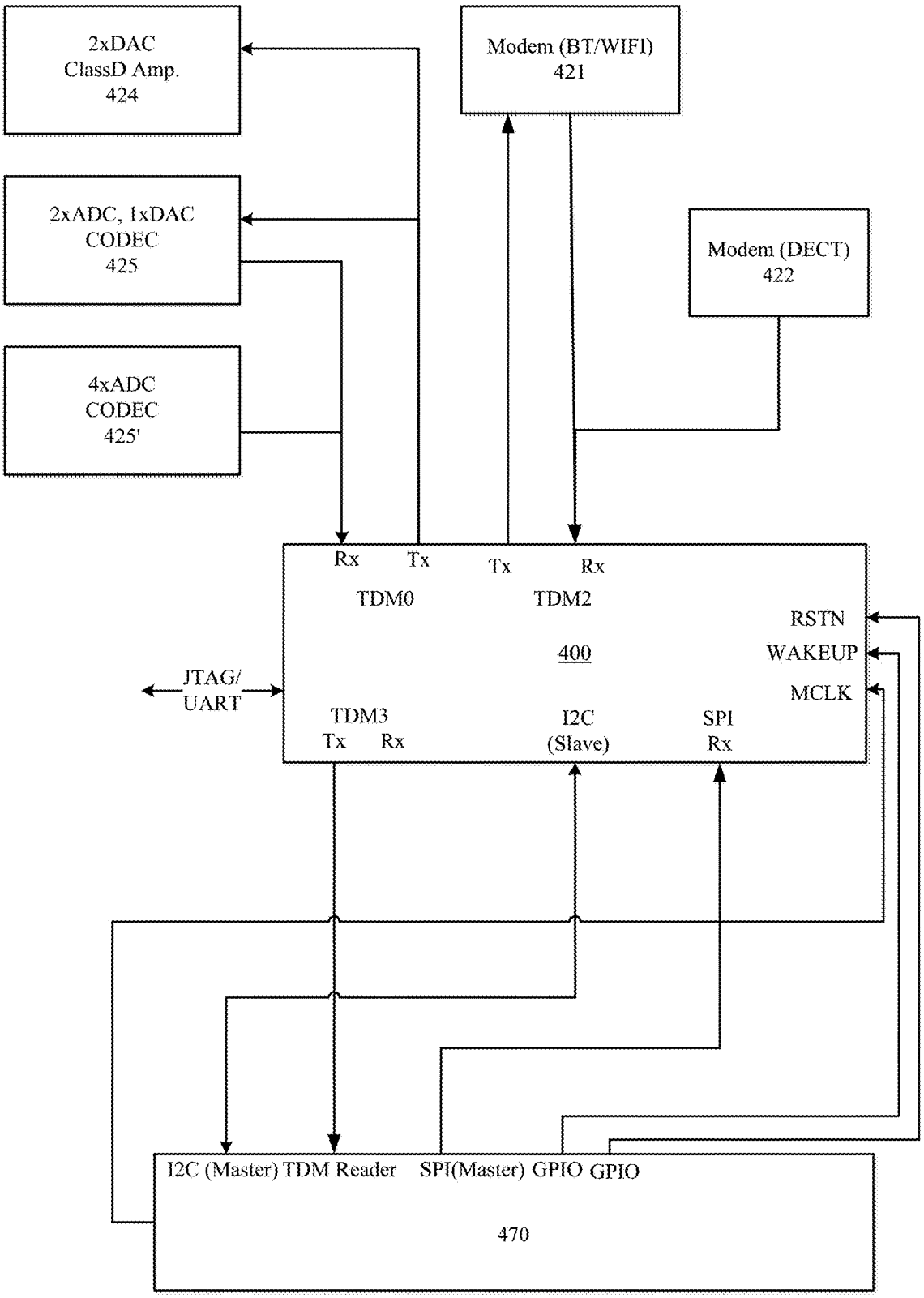
FIG. 3B illustrates an audio hub and multiple devices according to an embodiment of the invention.

FIGS. 3A and 3B illustrate audio hub 400 and host processor 470.

Audio hub 400 includes the following interfaces:

a. IC2 slave interface—coupled via an I2C bus to an IC2 master interface of host processor 470.
b. Clock input MCLK for receiving a clock signal from host processor 470.
c. Input ports for receiving control signals RSTN and WAKEUP from host processor 470.
d. Three first communications interfaces
   i. TDM0—coupled to CODECS such as CODEC 425' that includes four ADCs and CODEC 425 that has three ADCs and one DAC.
   ii. TDM1—coupled to a DECT modem 422.
   iii. TDM2 coupled to a BT/WIFI modem 421.
e. Second communication interface TDM3—coupled to host processor 470.
f. Additional input that is coupled to JTAG or UART bus.

In FIGS. 3A and 3B, audio hub 400 has 4 full duplex TDM ports and single SPI full duplex interfaces.

FIGS. 3A and 3B differ from each other by the presence or absence of an SPI bus. FIG. 3B illustrates the host processor 470 as controlling audio hub 400 via an SPI bus—that may be coupled between an SPI (master) port of host processor 470 and RX port of SPI of audio hub 400. This SPI bus is not present in FIG. 3A.

Figure 3C:
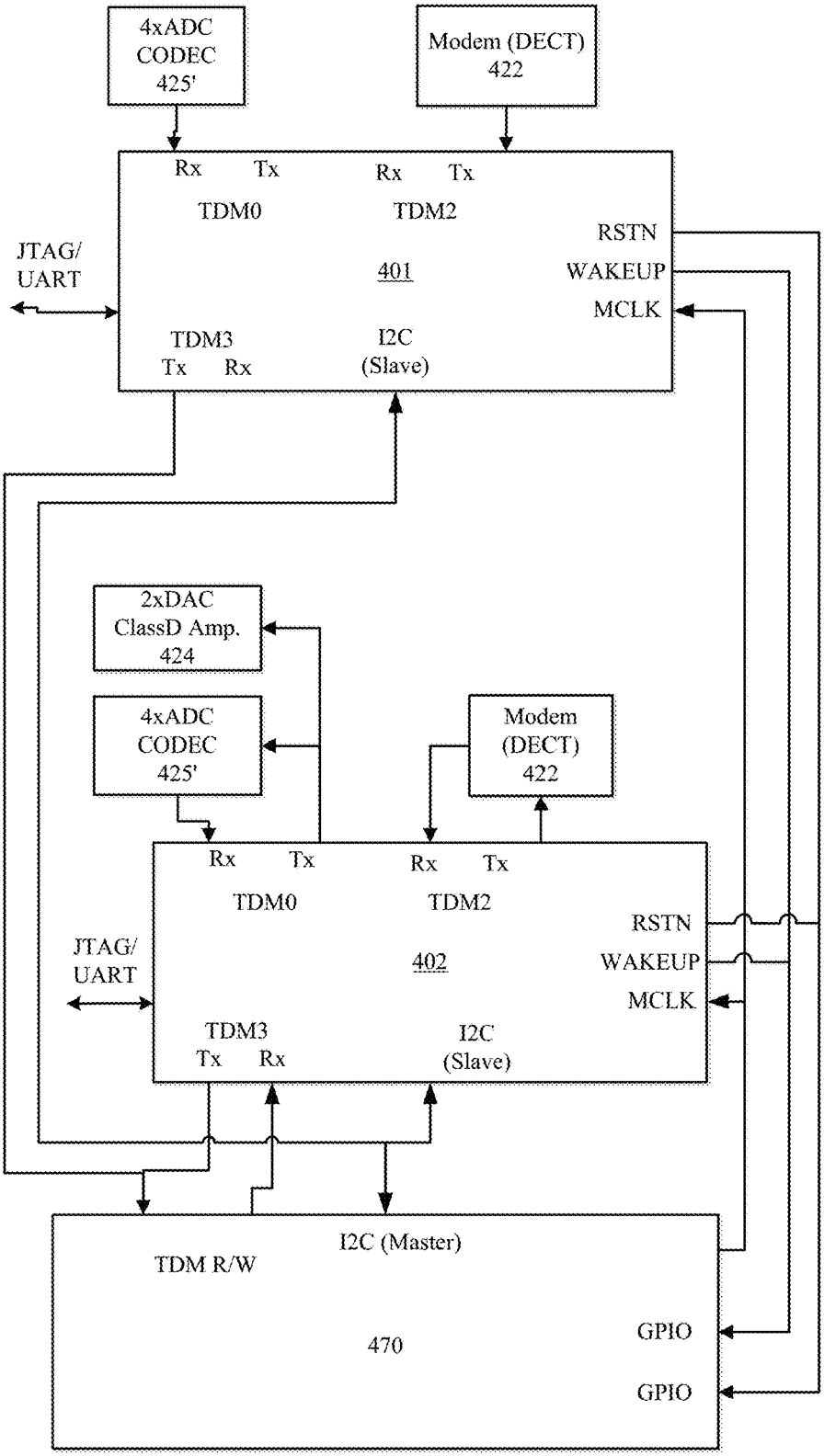
FIG. 3C illustrates two audio hubs and multiple devices according to an embodiment of the invention.

FIG. 3C illustrates host processor 470 first audio hub 401 and second audio hub 402.

In FIG. 3C some of the components that are coupled to audio hub 400 are spread between first audio hub 401 and second audio hub 402.

First audio hub 401 and second audio hub 402 and host processor 470 share TDM3, IC2 and SPI buses. Host processor 470 sends control signals RSTN, WAKEUP and clock signal to first audio hub 401 and to second audio hub 402.

Figure 4:
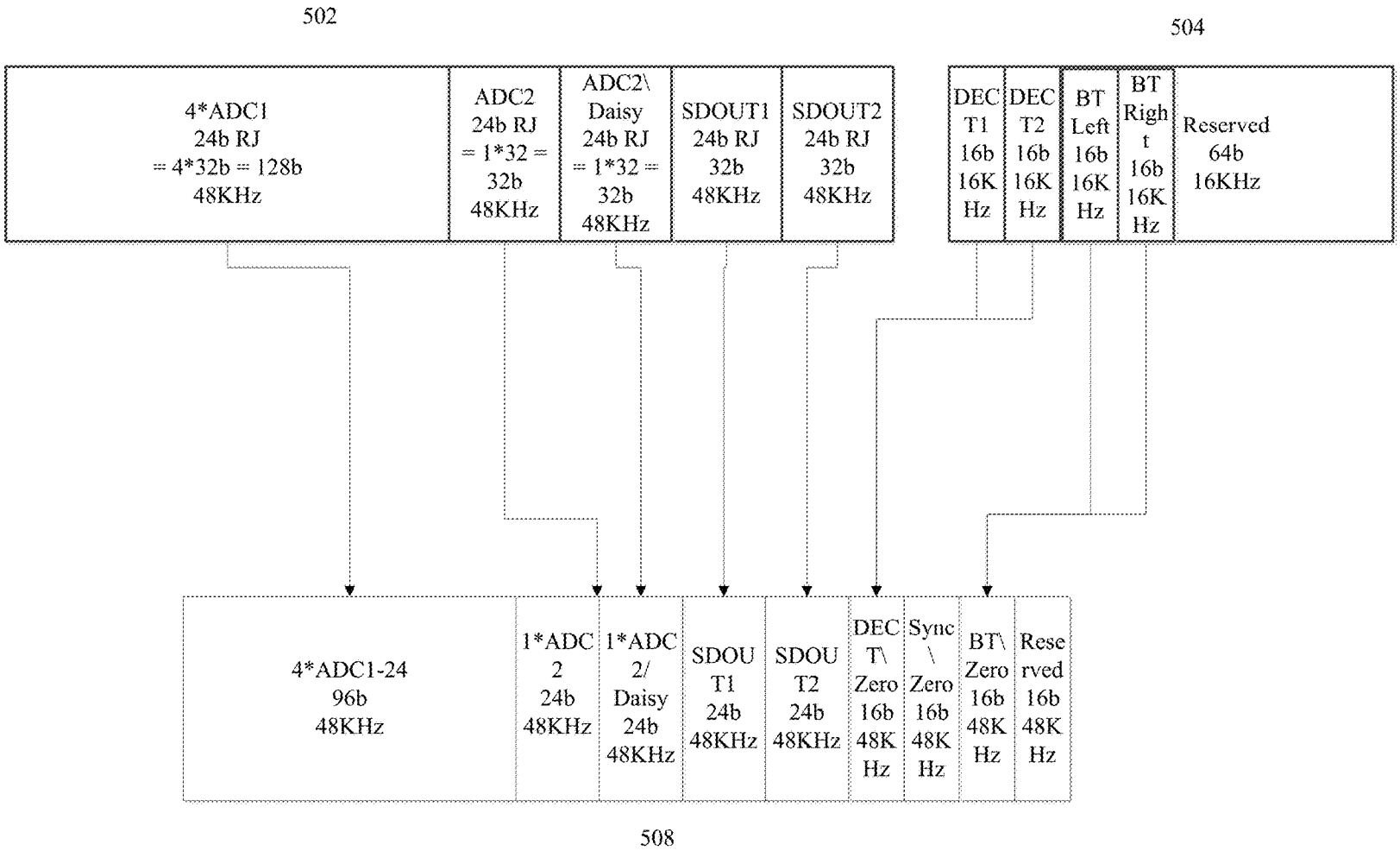
FIG. 4 illustrates various transmission path frames according to an embodiment of the invention.

FIG. 4 illustrates various transmission path frames according to an embodiment of the invention.

These transmission frames are transmitted in the system of FIGS. 3A and 3B.

The transmission path frames include: (i) transmission frame 502 received at RX port of TDM0 of audio hub 400, (ii) transmission frame 504 received at RX port of TDM2 of audio hub 400, (iii) transmission frame 508 outputted (to host processor 470) from TX port of TDM3 of audio hub 400.

The transmission frame 502 has 32 b chunks that are truncated to 24 b chunks in transmission frame 508.

In FIG. 4, Frame 502 consists of:

Channels 1-4: 4 ADCs for 4 on-board analog MICs, coming from codec 425' in FIG. 3A.

Channels 5-6: 2 ADCs for 2 external wired analog MICs or 1 external wired analog MIC+single analog daisy chain input, coming from codec 425 in FIG. 3A.

Channels 7-8: 2 feedback input channels of speakers amplifiers' operation, coming from ClassD Amp. 424 in FIG. 3A.

Each channel requires 24 b sample width @ 48 KHz sampling rate but due to Codec 425 & 425' limitations each channel should be transmitted in the frame in a 32 b container. Therefore 8*24 bit @ 48 KHz, behave like 8*32 bit RJ@ 48 KHz. Total frame size is 256 b.

In FIG. 4, Frame 504 consists of:

Channels 1-2: 2 input channels for remote wireless DECT microphones, coming from modem DECT 422 in FIG. 3A.

Channels 3-4: 2 input channels (stereo, left/right) for BT Handsfree Device, coming from modem BT 421 in FIG. 3A.

Channels 5-8: 4 reserved channels to create needed (by modems) 128 b frame in FIG. 3A.

Each channel requires 16 b sample width @ 16 KHz sampling rate. Therefore 4*16 bit @ 16 KHz. Total frame size is 128 b.

Audio hub 400 in FIG. 3A, aggregates all above received channels into a single frame (508 in FIG. 4), to be transmitted towards host processor 470.

Frame 508 should support the highest sampling rate, therefore operates in 48 KHz and should efficiently include all desired channels from all sources.

Therefore audio hub 400 constructs frame 508 in a way to include all data without any unneeded/reserved bits:

Channels 1-4: 4 ADCs for 4 on-board analog MICs, coming from codec 425' in FIG. 3A. 24 b per channel @ 48 KHz Channels 5-6: 2 ADCs for 2 external wired analog MICs or 1 external wired analog MIC+single analog daisy chain input, coming from codec 425 in FIG. 3A. 24 b per channel @ 48 KHz Channels 7-8: 2 feedback input channels of speakers amplifiers' operation, coming from ClassD Amp. 424 in FIG. 3A. 24 b per channel @ 48 KHz.

Channel 9: 2 input channels for remote wireless DECT microphones, coming from modem DECT 422 in FIG. 3A. 16 b per channel @ 16 KHz. For optimized operation the two 16 KHz channels are interleaved and transmitted over a single 48 KHz.

Channel 10: to support channels 9 & 11, interleaving operation of a 16 KHz channels over a single 48 KHz channel, a synch channel is needed to allow the receiver (host processor 470) to correctly decode these channels regarding which left/right/zero channel data is currently received.

Channel 11: 2 input channels (stereo, left/right) for BT Handsfree Device, coming from modem BT 421 in FIG. 3A. 16 b per channel @ 16 KHz. For optimized operation the two 16 KHz channels are interleaved and transmitted over a single 48 KHz.

Channel 12: 4 reserved channel to create needed (by host) 256 b frame in FIG. 3A.

Frame 508 contains 48 KHz and 16 KHz data together (3:1 ratio), thus from first frame out, each first two frames out of three frames contain valid 16 KHz output (BT left/right channels and DECT ½ channels), and one frame contains zero padding. A 16 KHz synch marker must be written, to enable audio hub/host processor verifying it is synchronized on the correct 16 KHz frame.

Figure 5:
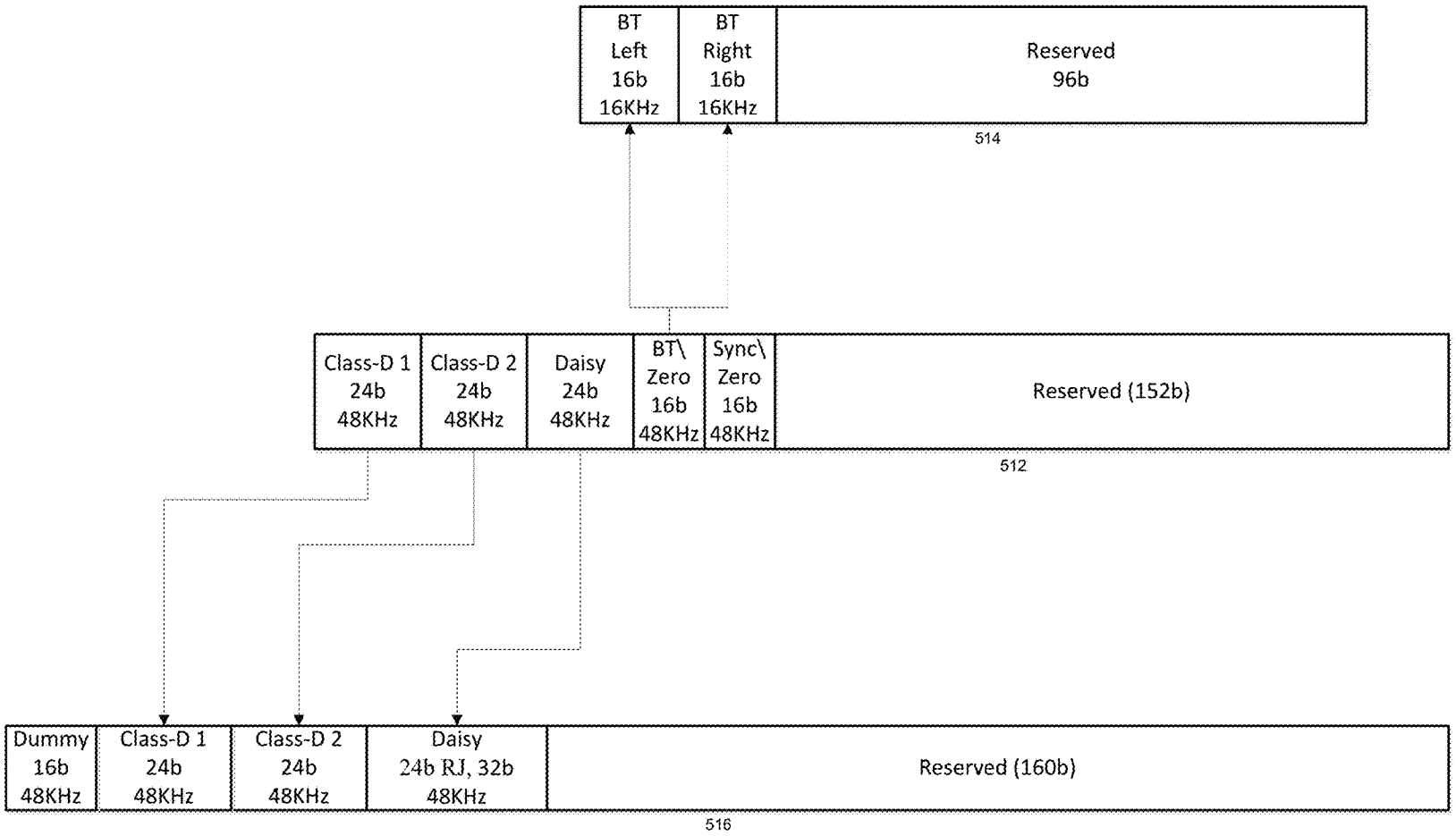
FIG. 5 illustrates various reception path frames according to an embodiment of the invention.

FIG. 5 illustrates various reception path frames according to an embodiment of the invention.

These reception frames are transmitted in the system of FIGS. 3A and 3B.

The reception path frames include: (i) reception frame 512 received at RX port of TDM3 of audio hub 400 (from host computer 470), (ii) reception frame 514 transmitted from TX port of TDM2 of audio hub 400, and (ii) reception frame 516 transmitted from TX port of TDM3 of audio hub 400.

Audio hub 400 in FIG. 3A, receives a single frame (512 in FIG. 5), to be distributed and transmitted towards several components: codec 425, ClassD Amp 424, modem BT 421.

Frame 512 should support the highest sampling rate, therefore operates in 48 KHz and should efficiently include all desired channels to all sources. Therefore host processor 470 constructs frame 512 as follows:

Channels 1-2: 2 output channels of speakers' amplifiers, going to ClassD Amp 424 in FIG. 3A. 24 b per channel @ 48 KHz.

Channels 3: single analog daisy chain's output, going to codec 425 in FIG. 3A. 24 b @ 48 KHz Channel 4: 2 output channels (stereo, left/right) for BT Handsfree Device, going to modem BT 421 in FIG. 3A. 16 b per channel @ 16 KHz. For optimized operation the two 16 KHz channels are interleaved and transmitted over a single 48 KHz.

Channel 5: to support channel 4, interleaving operation of a 16 KHz channels over a single 48 KHz channel, a synch channel is needed to allow the receiver (audio hub 400) to correctly decode these channels regarding which left/right/zero channel data is currently received.

Channel 6: reserved channels to create needed (by host) 256 b frame in FIG. 3A.

Frame 512 contains 48 KHz and 16 KHz data together (3:1 ratio), thus from first frame out, each first two frames out of three frames contain valid 16 KHz output (BT left/right channels), and one frame contains zero padding. A 16 KHz synch marker must be written, to enable audio hub/host processor verifying it is synchronized on the correct 16 KHz frame.

FIG. 5, Frame 516 consists of:

Channel 1: a dummy channel to solve codec 425 32 b alignment limitation. 16 b @ 48 KHz channel Channels 2-3: 2 output channels of speakers' amplifiers, coming from ClassD Amp. 424 in FIG. 3A. 24 b sample width @48 KHz Channels 4: single analog daisy chain's output, going to codec 425 in FIG. 3A. 24 b @ 48 KHz transmitted in the frame in a 32 b container. Therefore 24 bit @ 48 KHz, behave like 32 bit RJ @48 KHz.

Channel 5: reserved channels (5×32 b) to create needed 256 b frame for codec 425' and ClassD Amp. 424 in FIG. 3A.

Total frame size is 256 b.

FIG. 5, Frame 514 consists of:

Channels 1-2: 2 output channels (stereo, left/right) for BT Handsfree Device, going to modem BT 421 in FIG. 3A. 16 b sample width @ 16 KHz sampling rate.

Channel 3: 6 reserved channels (6*16 b=96 b) to create needed (by BT modem) 128 b frame in FIG. 3A.

Total frame size is 128 b.

As can be seen from above configurations the audio hub supports many features/solutions to allow interfacing with various different components, each has its own limitation & requirements. While the audio hub 400, supports all these features to allow best utilization & efficient operation.

Figure 6:
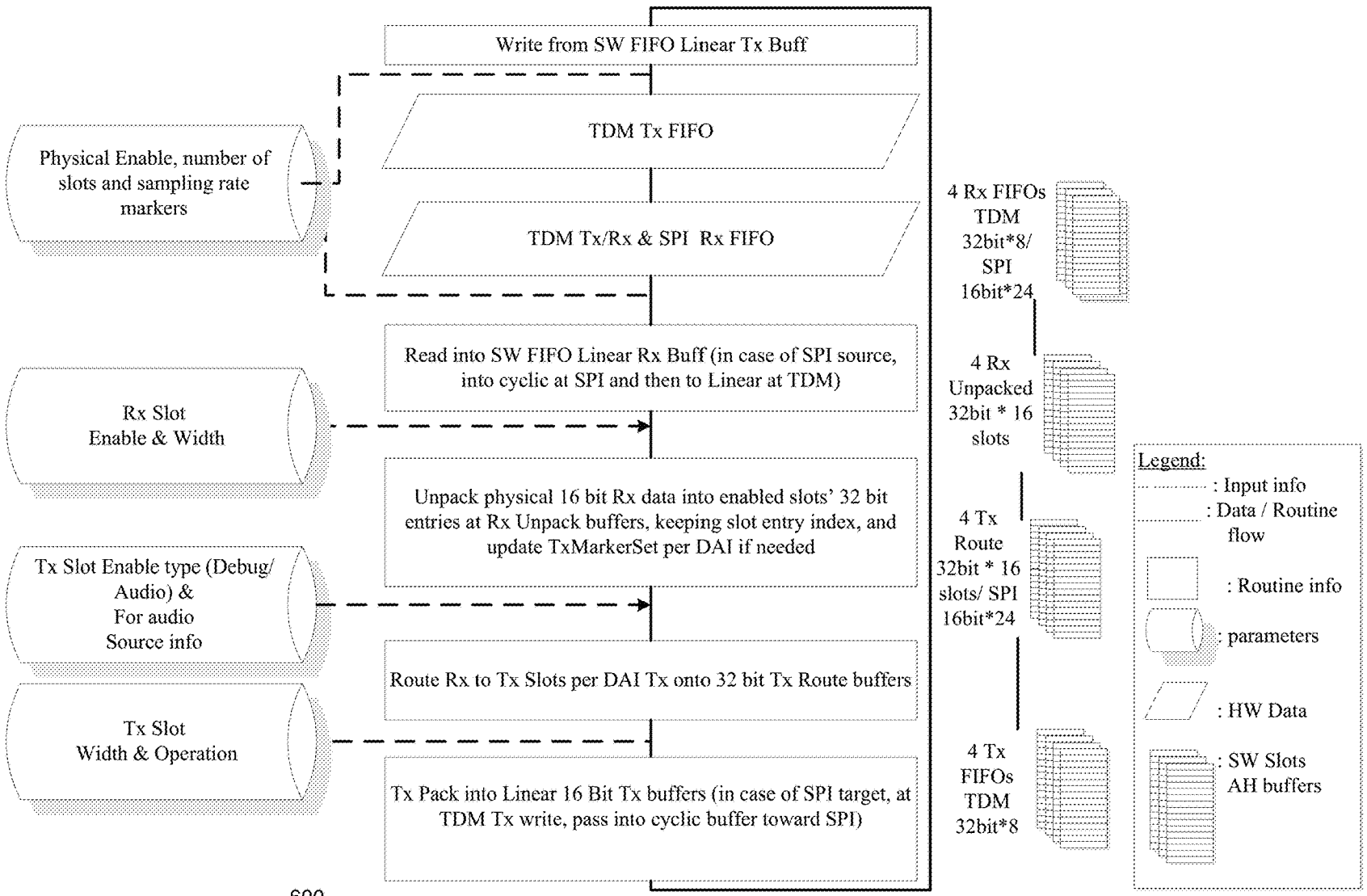
FIG. 6 illustrates a method according to an embodiment of the invention.
Figure 7:
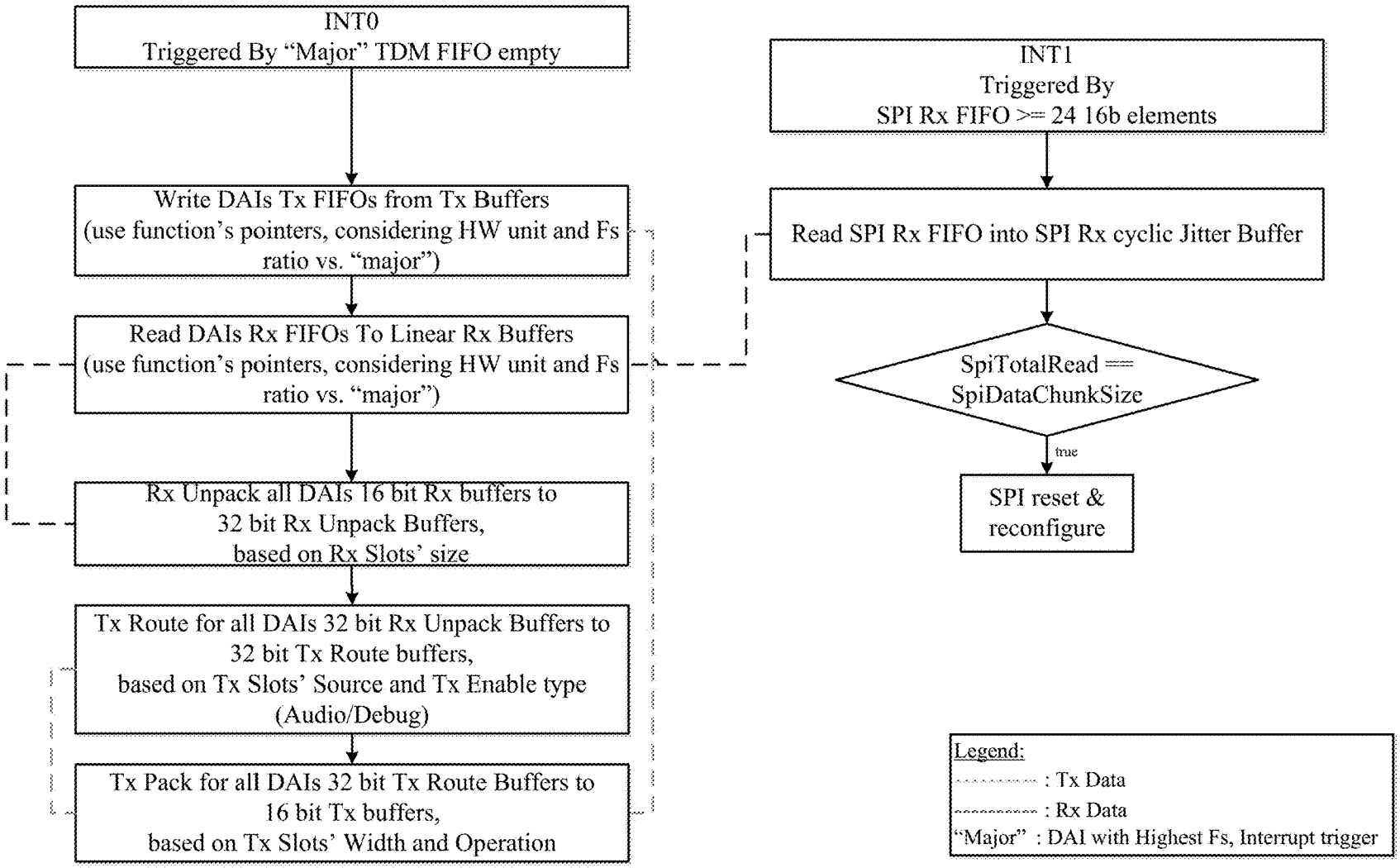
FIG. 7 illustrates a method according to an embodiment of the invention.
Figure 8:
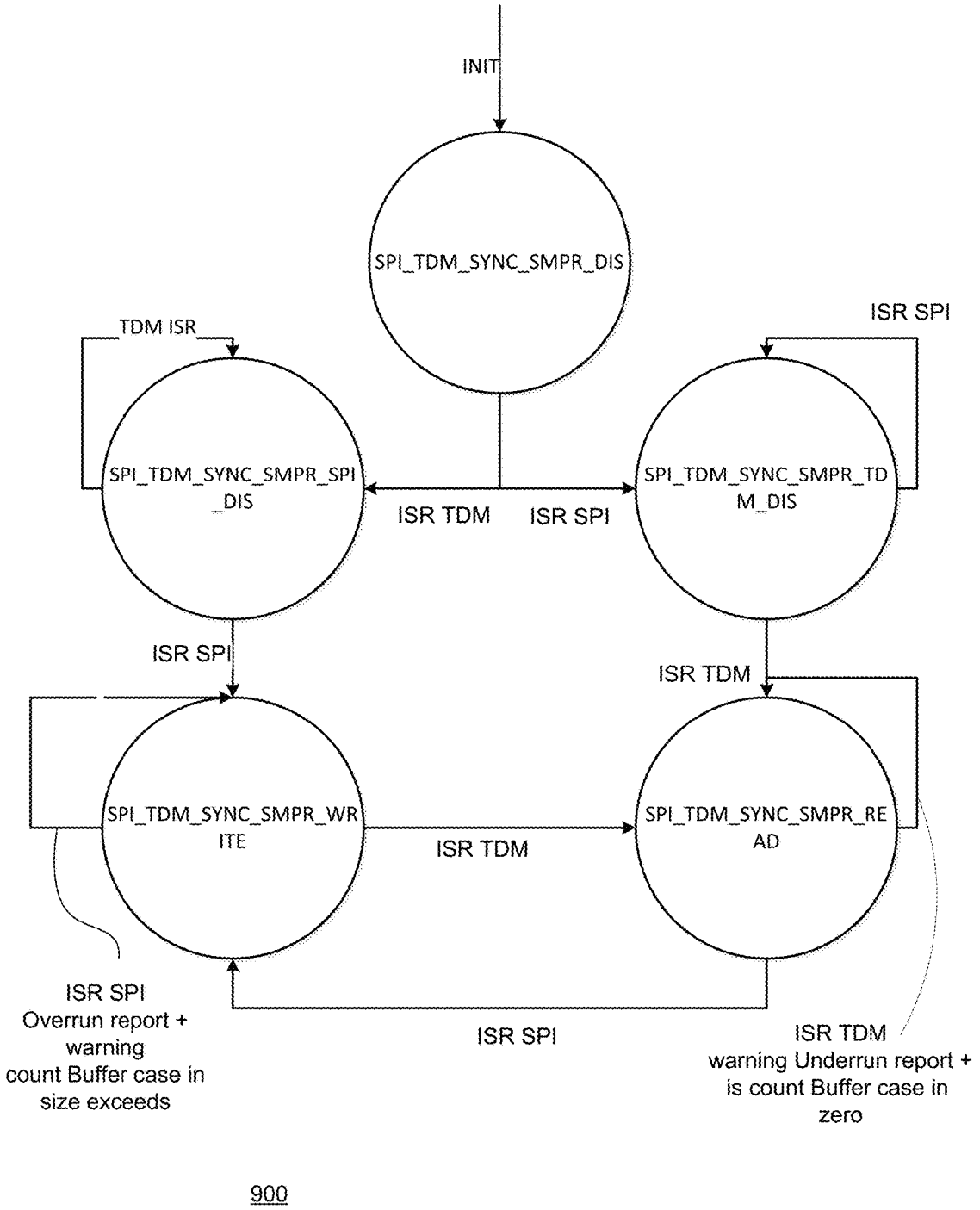
FIG. 8 illustrates a state machine according to an embodiment of the invention.

Referring to FIGS. 6 and 7—the system offers a very flexible system based on its 4 TDMs and SPI interfaces with per slot configuration.

For Simplicity, all interfaces work with worst case scenario, using configuration API to determine which slots are used.

The most sensitive TDM line in the system in terms of timings is TDM3 Tx, which is transmitting to the host processor 470 (Tx Path). Audio hub 400 is used as slave on TDM3 Tx line.

In this case:

TDM3 is set as 'Major' Slave.

It is attached to INT0, which is the highest priority interrupt, once it's FIFO is empty.

In this case other TDMs are set as 'Major' Master, according to the highest rate TDM (i.e. 48 KHz).

The audio routing is based on interrupts for Data transfer, Control and Debug.

Interrupts priority is from Highest to lowest: INT0, INT1, INT2 and VINT, while any lower priority interrupt enables higher level to come in.

INT0 with the TDM3 Tx data ISR is the most critical interrupt in the system, since it is designed to trigger when TDM3 Tx is empty, and therefore write/read to/from TDM's FIFO must be completed within single TDM sample time, before next Frame sync arrives. Any delay beyond FSYNC in this critical stage results with TDM drifts!!!

Here is the Interrupts assignment:

INT0→Data—TDM3 Duplex
INT1→Data—TDM0 Tx/SPI Rx
INT2→Control—$I^2c$ Duplex
VINT→Debug—UART Tx FIG. 7 shows audio hub would receive two kind of interrupts:

Slave TDM (INT0):

TDM3 Tx FIFO empty interrupt with 8*32-bit elements (256 b), sent to host processor. Slave TDM3 Write and read sent\received to\from host processor would be handled here.

Master TDM (INt1):

TDM0 Tx FIFO empty interrupt with 8*32-bit elements, sent to codecs. All Master TDMs 0, 1 & 2 write, read, mux and demux sent\received to\from codecs\BT\DECT would be handled here.

Another option of INT1 is handling of the SPI received data from the host processor in order to handle correctly and stay in synch with received data as SPI is an asynchronous interface.

As mentioned before in, the Slave INT0 has higher priority than the Master INT1.

As written above, a synch marker should be configured and written at lower sampling rates (DECT/BT channels (48:16 KHz ratio))

Steps in FIG. 7:

1. INTO will be configured to be triggered when there is a need to write necessary data for transmission, after previously written data has exhausted.
2. There is a time limitation of this requirement to write next frame data (256 b) to HW FIFOs therefore first the Tx data is processed. First TDM3 (host connectivity) followed by rest od required TDMs.
3. Next stage is to receive/empty all HW TDM's received FIFOs.

At this point, in case SPI is used as an alternative receive interface from the host processor, the data collected/read from SPI interface in INT1, will be processed and integrated into entire DB. At INT1 the SPI interface and buffers will be handles correctly in order to achieve correct operation.

4. The process of handling each sample from the time it received till its transmission to its target is illustrated in next steps. Place all samples in unified container (32 b), this operation is called unpacking. Using double buffer mechanism according to needs.
5. Routing correctly each sample to appropriate target TDMs buffers, which will be used for transmission.
6. Packing the desired samples, per interface, at the correct format according to channel definition of the interface.

Steps in FIG. 6:

1. Illustrates in more details the processes & DBs used in order to achieve the audio hub operation.
2. The DB used are (on the right):
   Each interface (TDMs & SPI) receive (Rx) FIFOs—to hold the entire data received with these interface per interrupt/per every time the HW accessed and read. Data placed in these buffers matches the HW FIFOs' format. Most upper DB
   Each interface (TDMs & SPI) transmit (Tx) FIFOs—to hold the entire data that should be written to these interfaces per interrupt/per every time the HW accessed and written. Data placed in these buffers matches the HW FIFOs' format. Most lower DB
   In the middle there are SW/logical buffers that allows the routing operation to be carried out efficient by first DB that spreads/unpack the entire received data to a standard format.
   The other is DB is to allow routing per sample/channel to its correct destination without (yet) its final format to be transmitted on the line. the system is ready to accommodate large number of slots and routing options.
3. The attributes/parameters (on the left) of the system:
   List of parameters/attributes used per stage in order to perform the correct operations over a desired received sample and to perform appropriate routing. It can be seen as if each received sample "travels" along the system together with its attributes to allow its proper processing.
4. First SW routine (Interrupts Service Routines (ISRs)) should write from the SW buffers to the HW FIFOs in the following order:
   1. TDM Tx FIFOs (first TDM3—host, followed by the rest of the TDMs)
   2. TDM/SPI RX FIFOs
   At this stage, all necessary Tx data was written & all required data was received and read.
5. Data is written to appropriate SW buffers (either linear or cyclic) depends on interface used.
6. According to enabled channels & its sample width, desired operations are performed in order to unpack all received data into to standard format to ease later on routing.
7. Route required sample to desired interface to be transmitted using source and destination info.
8. Prepare final SW buffers to be written at the next hw interrupt. Buffers should be built to allow fastest operation of the ISR write operation to the TX FIFOs. Therefore building of required format is performed here including synch channels.

There may be provided a method for operating an audio hub.

The method may include receiving content over first communication interfaces of an audio hub, generating a multiplex, and conveying the multiplex to a processor (such as a digital signal processor or any other processor) over a second communication interface. On the other direction receiving a multiplexed content from a processor by the audio hub, de-multiplexing/routing and conveying relevant content per first communication interface according to desired routing plan.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or inter-medial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements.

The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

Any reference to a system should be applied, mutatis mutandis to a method that is executed by a system and/or to a computer program product that stores instructions that once executed by the system will cause the system to execute the method. The computer program product is non-transitory and may be, for example, an integrated circuit, a magnetic memory, an optical memory, a disk, and the like.

Any reference to method should be applied, mutatis mutandis to a system that is configured to execute the method and/or to a computer program product that stores instructions that once executed by the system will cause the system to execute the method.

Any reference to a computer program product should be applied, mutatis mutandis to a method that is executed by a system and/or a system that is configured to execute the instructions stored in the computer program product.

The term "and/or" is additionally or alternatively.

The phrase "may be X" indicates that condition X may be fulfilled. This phrase also suggests that condition X may not be fulfilled. For example—any reference to a system as including a certain component should also cover the scenario in which the system does not include the certain component.

The terms "including", "comprising", "having", "consisting" and "consisting essentially of" are used in an interchangeable manner. For example—any method may include at least the steps included in the figures and/or in the specification, only the steps included in the figures and/or the specification. The same applies to the system and the mobile computer.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one as or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements the mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

Any combination of any component of any component and/or unit of system that is illustrated in any of the figures and/or specification and/or the claims may be provided.

Any combination of any system illustrated in any of the figures and/or specification and/or the claims may be provided.

Any combination of steps, operations and/or methods illustrated in any of the figures and/or specification and/or the claims may be provided.

Any combination of operations illustrated in any of the figures and/or specification and/or the claims may be provided.

Any combination of methods illustrated in any of the figures and/or specification and/or the claims may be provided.

Moreover, while illustrative embodiments have been described herein, the scope of any and all embodiments having equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present specification or during the prosecution of the application. The examples are to be construed as non-exclusive. Furthermore, the steps of the disclosed methods may be modified in any manner, including by reordering steps and/or inserting or deleting steps. It is intended, therefore, that the specification and examples be considered as illustrative only, with a true scope and spirit being indicated by the following claims and their full scope of equivalents.

We claim:

1. A system comprising a first processor and an audio hub;

wherein the audio hub comprises first communication interfaces, a second communication interface, a second processor, and a memory; wherein the second processor is a digital signal processor and wherein the first processor is a host processor or an application processor;

wherein the first communication interfaces are configured to exchange audio signals with a group of audio components of different types; wherein an aggregate number of first communication interface bits exceeds a number of second communication interface bits;

wherein the audio signals comprise input audio signals received from the group and output audio signals transmitted to the group;

wherein the second processor is configured to generate an input multiplex of input audio signals; and wherein the second communication interface is configured to transmit the input multiplex to the first processor and to receive an output multiplex from the first processor.

2. The system according to claim 1 wherein the audio hub is configured to generate the input multiplex based on a mapping stored in the audio hub.

3. The system according to claim 1 wherein the audio hub is configured to generate the input multiplex based on types of audio signals requested by the first processor and based on a usage of the first communication interfaces.

4. The system according to claim 1 wherein the audio hub is configured to generate the input multiplex to include audio signals of different rate.

5. The system according to claim 1 wherein the audio hub is configured to generate the input multiplex by truncating audio signal chunks.

6. The system according to claim 1 wherein the audio hub is configured to generate the input multiplex from audio signals received from one or more wireless modems, from one or more CODEC and from one or more digital microphones.

7. The system according to claim 1 wherein the audio hub is configured to generate the input multiplex from audio signals received from wireless antennas, from wired cables, and from digital microphones.

8. The system according to claim 1 wherein first communication interfaces comprise a first plurality of time division multiplex buses.

9. The system according to claim 1 comprising an additional audio hub; wherein the first processor is configured to control the additional audio hub.

10. The system according to claim 9 wherein the additional audio hub comprises additional first communication interfaces, an additional second communication interface, an additional processor, and an additional memory; wherein the additional first communication interfaces are configured to exchange audio signals with an additional group of audio components of different types; wherein an aggregate number of additional first communication interface bits exceeds a number of additional second communication interface bits; wherein the additional audio signals comprise additional input audio signals received from the additional group and additional output audio signals transmitted to the additional group; wherein the additional processor is configured to generate an additional input multiplex of additional input audio signals; and wherein the additional second communication interface is configured to transmit the additional input multiplex to the first processor and to receive an additional output multiplex from the first processor.

11. The system according to claim 10 wherein the first processor is configured to control the first and second audio hubs using a shared control bus.

12. The system according to claim 10 wherein the additional second communication interface and the second communication interface are coupled to the processor over a shared bus.

13. A method, comprising:

exchanging, by first communication interfaces of an audio hub, audio signals with a group of audio components of different types; wherein an aggregate number of first communication interface bits exceeds a number of second communication interface bits; wherein the audio hub also comprises a second communication interface, a second processor, and a memory; wherein the audio signals comprise input audio signals received from the group and output audio signals transmitted to the group;

generating, by the second processor, an input multiplex of input audio signals; and transmitting, by the second communication interface, the input multiplex to a first processor; wherein the second processor is a digital signal processor and wherein the first processor is a host processor or an application processor; and receiving, by the second communication interface, an output multiplex from the first processor.

14. The method according to claim 13 comprising generating, by the audio hub, the input multiplex based on a mapping stored in the audio hub.

15. The method according to claim 13 comprising generating, by the audio hub, the input multiplex based on types of audio signals requested by the first processor and based on a usage of the first communication interfaces.

16. The method according to claim 13 comprising generating, by the audio hub, the input multiplex to include audio signals of different rate.

17. The method according to claim 13 comprising generating, by the audio hub, the input multiplex by truncating audio signal chunks.

18. The method according to claim 13 comprising generating, by the audio hub, the input multiplex from audio signals received from one or more wireless modems, from one or more CODEC and from one or more digital microphones.

19. The method according to claim 13 comprising generating, by the audio hub, the input multiplex from audio signals received from wireless antennas, from wired cables, and from digital microphones.

20. The method according to claim 13 wherein first communication interfaces comprise a first plurality of time division multiplex buses.

21. The method according to claim 13 wherein the audio hub comprises an additional audio hub; wherein the method comprises controlling, by the first processor, the additional audio hub.

22. The method according to claim 13 wherein the additional audio hub comprises additional first communication interfaces, an additional second communication interface, an additional processor, and an additional memory; wherein the method comprises:

exchanging, by the additional first communication interfaces, audio signals with an additional group of audio components of different types; wherein an aggregate number of additional first communication interface bits exceeds a number of additional second communication interface bits; wherein the additional audio signals comprise additional input audio signals received from the additional group and additional output audio signals transmitted to the additional group;

generating, by the additional processor, an additional input multiplex of additional input audio signals;

transmitting, by the additional second communication interface, the additional input multiplex to the first processor; and receiving, by the additional second communication interface, an additional output multiplex from the first processor.

23. The method according to claim 22 comprising controlling, by the first processor, the first and second audio hubs using a shared control bus.

24. The method according to claim 22 wherein the additional second communication interface and the second communication interface are coupled to the first processor over a shared bus.

* * * * *